US006722150B1

(12) United States Patent
Carr et al.

(10) Patent No.: US 6,722,150 B1
(45) Date of Patent: Apr. 20, 2004

(54) REFRIGERATED COUNTER TOP FOOD PAN UNIT

(75) Inventors: David J. Carr, Valley Center, CA (US); Dennis L. Baer, Moreno Valley, CA (US)

(73) Assignee: C & S Solutions, LLC, San Diego, CA (US)

( * ) Notice: Subject to any disclaimer, the term of this patent is extended or adjusted under 35 U.S.C. 154(b) by 0 days.

(21) Appl. No.: 10/302,506

(22) Filed: Nov. 21, 2002

(51) Int. Cl.[7] ..... F25D 23/12
(52) U.S. Cl. ..... 62/258; 62/410
(58) Field of Search ..... 62/258, 440, 446, 62/410, 411

(56) References Cited

U.S. PATENT DOCUMENTS

| | | | |
|---|---|---|---|
| 4,593,752 | A | 6/1986 | Tipton |
| 5,117,649 | A | 6/1992 | Mangini et al. |
| 5,168,719 | A | 12/1992 | Branz et al. |
| 5,247,807 | A | 9/1993 | Jarman et al. |
| 5,355,687 | A | 10/1994 | Carpenter et al. |
| 5,363,672 | A | 11/1994 | Moore et al. |
| 5,388,429 | A | 2/1995 | Shackelford et al. |
| 5,475,987 | A | 12/1995 | McGovern |
| 5,477,702 | A | 12/1995 | Kennedy et al. |
| 5,927,092 | A | 7/1999 | Kushen et al. |
| 6,000,236 | A | 12/1999 | Hassis |
| 6,109,051 | A | 8/2000 | Majordy |
| 6,151,905 | A | 11/2000 | Smith |
| 6,202,432 | B1 | 3/2001 | Hassis |
| 6,293,124 | B1 | 9/2001 | Roth et al. |
| 6,385,990 | B1 | 5/2002 | Lee |
| 6,434,962 | B1 | 8/2002 | Moretti et al. |

OTHER PUBLICATIONS

Randell Custom Modular 54000A Series Brochure, Randell Manufacturing, Inc. Revised Jan. 1997 CM. Sec. 8, p. 6.

*Primary Examiner*—William E. Tapolcai
(74) *Attorney, Agent, or Firm*—Henri J. A. Charmasson; John D. Buchaca

(57) ABSTRACT

A refrigerated, open-top food pan that can be used as a counter top buffet, as a store self-service display or as a kitchen food ingredient holder, has two cooling systems. The first one discharges a blast of cool air through the exit ports of an manifold peripherally mounted near the upper rim of the pan. The cooled air is generated by a bwer taking air from a grated port in the inner side wall and forcing it through a chamber housing a cooling expansion coil. A secondary cooling system has an expansion tube in intimate and circuitous contact with the bottom and side wall of the pan.

9 Claims, 2 Drawing Sheets

REFRIGERATED COUNTER TOP FOOD PAN UNIT

FIELD OF THE INVENTION

This invention relates to refrigerators, cool chambers and other such enclosures for the safe-keeping and preservation of foodstuff, and more particularly to refrigerated, open-top food displays and counter top buffets.

BACKGROUND OF THE INVENTION

Open-top, refrigerated food containers are commonly found on display units of self-service stores, in counter tops of self-service restaurants and the kitchen of restaurants. Dishes offering a variety of fares or food ingredients are placed in the shallow well of the container so they can be easily accessed by the customer or food preparator. Keeping the food dishes, buckets or pans and their contents refrigerated while in such an open top device has always been problematic. Most refrigerated food pans of the prior art uses the same cooling techniques used in refrigerators which consists in running a cooling expansion coil in a circuitous pattern in close contact with the bottom and wall of the pan. While this system maintains a relatively low temperature within the confines of the pan, it relies on temperature transfer from the expansion coil to the lining of the pan, to the container and finally, to the food item. The dishes may be made of synthetic or earth materials with relatively poor coefficient of heat transfer. Delay between the placement of the food container into the pan and cooling of the food may be longer than the time it takes the customers to empty the container. Many refrigerated food displays, notably those used in the kitchens of restaurants to hold the ingredients of dishes being prepared, consist of refrigerated cabinets having a large cut-out in the top. Containers are supported over this open top by a series of rails. The flow of cooling air is generated and often extends into the lower part of the cabinet as taught by U.S. Pat. No. 5,168,719 Branz et al. The cooling effect of this type of device is seriously affected every time the front door of the cabinet is opened to get access to items stored therein. Another prior art approach has been to divide the food pan into separate compartments by refrigerated partitions. This last solution imposes limits upon the type, number and arrangement of the containers within the pan.

The instant invention results from an attempt to devise a more efficient open-top food display.

SUMMARY OF THE INVENTION

The principal and secondary objects of this invention are to provide an open-top refrigerated shallow food pan suitable for holding a number of food dishes, or other containers and rapidly bringing and keeping their contents to a relatively low, even temperature for preserving the integrity and taste of the foodstuff.

Another object of this invention is to provide a compact open-top food pan refrigerated by a flow of cooled air generated and distributed by a structure that does not extend below the bottom level of the pan.

It is also an object of this invention to provide an efficient open-top, refrigerated food pan which is relatively easy to clean, service and repair.

These and other valuable objects are achieved by an open-top food pan that comprises an inner liner including a flat and unpunctured bottom plate and a relatively shallow peripheral wall integrally and seamlessly made of a material having a high coefficient of thermal transfer such as a metal; and an outer shell which is spaced apart from the liner to define a space therebetween. That space if first occupied by a chamber housing a mechanism that provides a source of pressurized cold fluid, either gas or fluid mist, and preferably air. The chamber is directly accessible by removal of a panel in the wall of the liner. The part of the interspace not occupied by the chamber is filled with insulating material such as injected and expanded styrofoam. One axial end of the chamber is connected to a blower which sucks air from an opening in the wall of the liner and axially forces it across a spirally coiled expansion cooling duct. The opposite end of the chamber is connected to a manifold running peripherally between the liner and the outer shell near the upper rim of the pan. A series of exit ports along the manifold are sized and oriented to discharge the cold fluid across the upper region of the pan. No part of the cooled air generating and distributing apparatus extends below the bottom level of the pan.

A second expansion cooling duct is run along a circuitous path within the interspace and in intimate contact with the bottom and wall of the pan. Food to be displayed in the pan is preferably placed in individual containers with upper rims rising slightly above the level of the cold air exit ports so that the cooling fluid can be forced between the containers for a more rapid and efficient cooling of the foodstuff.

DESCRIPTION OF THE PREFERRED EMBODIMENT OF THE INVENTION

Figure 1:
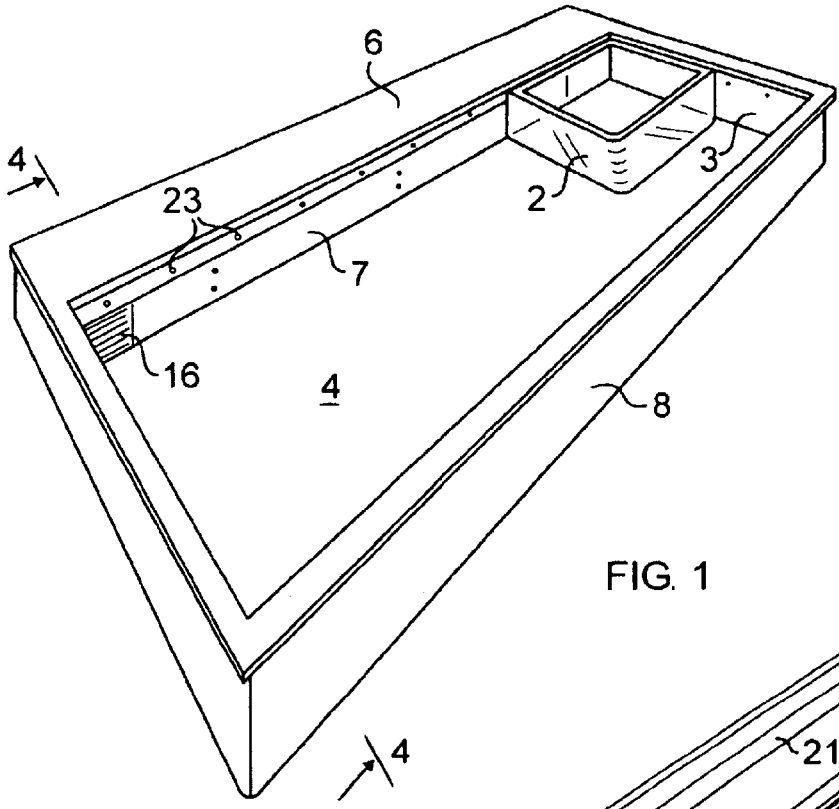
FIG. 1 is a front, top and right side perspective view of a food pan according to the invention.
Figure 2:
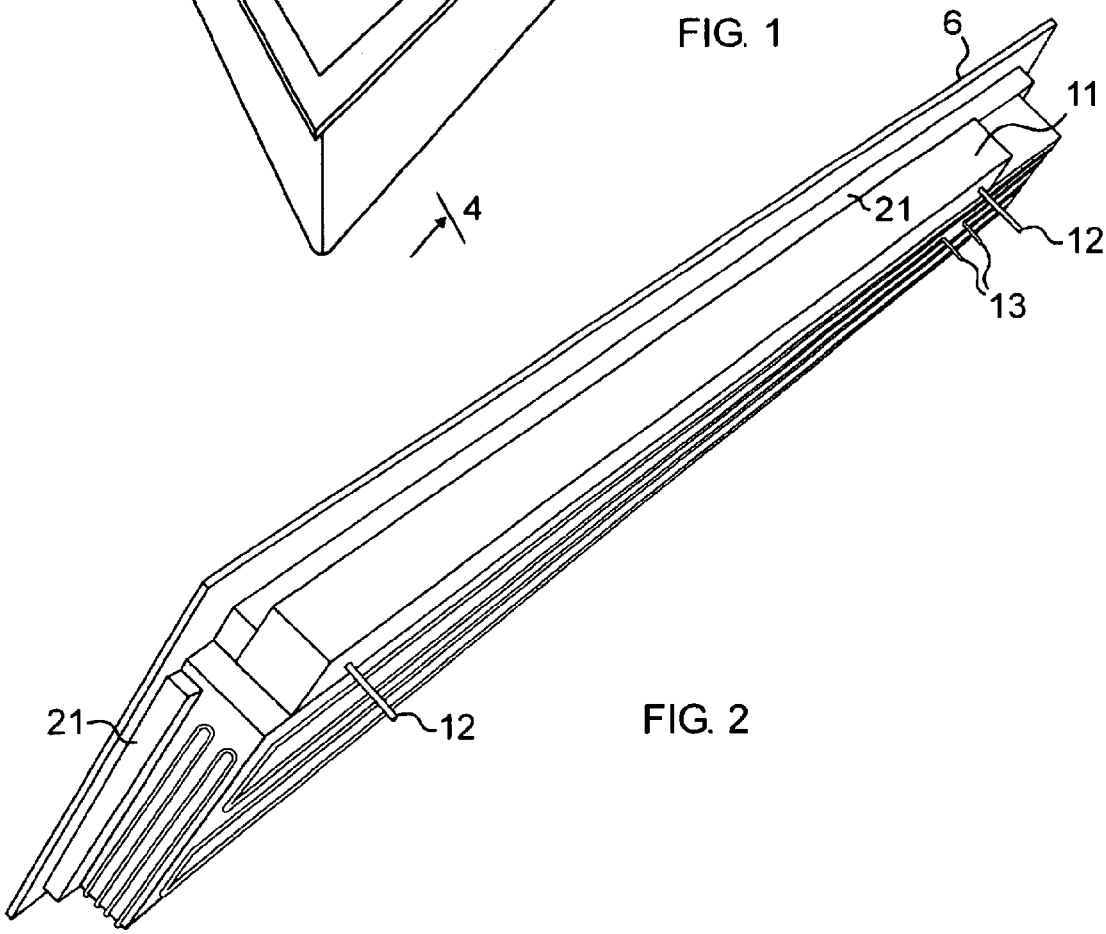
FIG. 2 is a back, bottom and left side perspective view thereof with the outer shell and insulating material removed.
Figure 3:
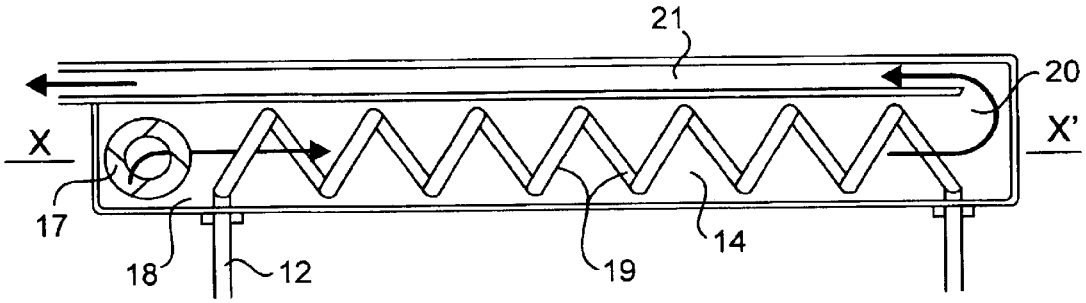
FIG. 3 is a cross-sectional view of the forced cool air generator.
Figure 4:
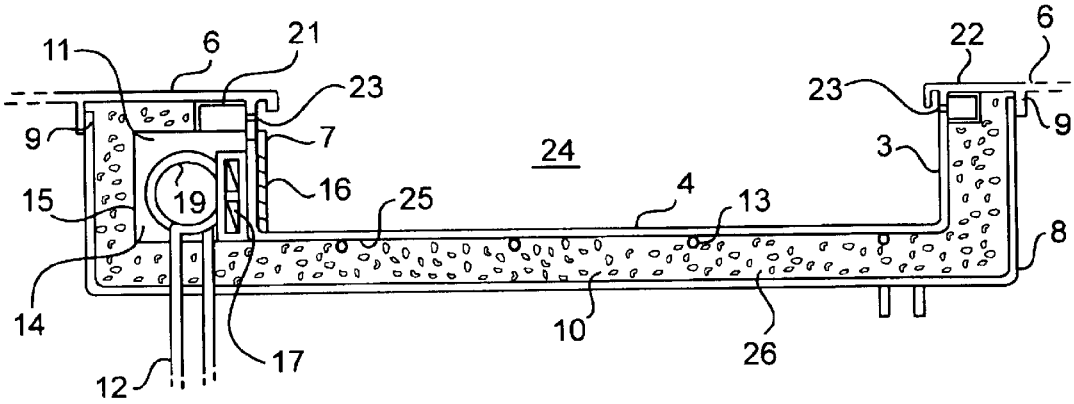
FIG. 4 is a cross-sectional view taken along line 4—4 of FIG. 1.

Referring now to the drawing, there is shown an open-top, food pan 1 preferably sized to be mounted in the top well of a counter cabinet (not shown on the drawing). The pan is designed to accommodate a plurality of food containers 2 of which only one is shown on the drawing. The pan comprises an inner liner 3 which is preferably made of a material having high coefficient of thermal conductivity such as enameled, galvanized, or stainless steel. The liner consists of a flat bottom 4, a shallow peripheral wall 5 whose upper edge meets a counter top surface 6. A window cut in the back wall of the liner is covered by a detachable plate 7. An outer shell 8 is joined to the counter top surface at its upper edge 9. The outer shell is spaced apart from the liner creating therebetween, a space 10 which is occupied, in part, by a forced cool air generator 11 located immediately behind the liner plate 7. The food pan is used in connection with a conventional refrigerating system whose compressor and fluid reservoir (not shown in the drawing) are preferably packaged in the cabinet supporting the pan. Only two expansion cooling ducts 12, 13 are illustrated. The forced cool air generator 11 is held in an elongated chamber 14 having a longitudinal axis X—X' horizontal and parallel to a side 5A of the peripheral wall. The chamber is defined by an enclosure 15 including the liner plate 7 and runs along said side of the peripheral wall. Mounted against a grate 16 at the right end of the liner plate 7 is a blower 17 that sucks air out of the pan through the grate and forces it through a first axial opening 18 axially across a series of spiral coils 19 formed in the first cooling expansion duct 12. A second opening 20 at the opposite end of the chamber is connected to a manifold 21, the manifold runs between the liner and the outer shell along the entire periphery of the pan near its upper rim 22. A series of exit ports 23 in the manifold and corresponding bores in the liner discharge the pressurized cooled air provided by the cooled air generator 11 across the upper region 24 of the pan. The blower 17 and cooling duct coils 19 can be easily accessed for cleanup and maintenance by removing the liner plate 7. No part of the cooled air generating and distributing structure including the chamber 14 and manifold 21 extend below the bottom 4 of the pan and into any supporting cabinet (not shown in the drawing) that may be formed by a downward extension of the outer shell 8.

The second cooling expansion duct 13 is run in a circuitous path against the inner surface 25 of the liner providing an additional cooling system for the pan.

Insulating material 26 such as expanded styrofoam is stuffed between the liner 3 and the outer shell 8.

While the preferred embodiments of the invention have been described, modifications can be made and other embodiments may be devised without departing from the spirit of the invention and the scope of the appended claims.

What is claimed is:

1. A refrigerated, open-top food pan which comprises:

an inner liner including a flat bottom plate and a peripheral side wall;

an outer shell spaced-apart from said liner and defining an enclosed space therebetween;

a volume of insulation in said space;

a source of pressurized cooled fluid; and a peripheral manifold connected to said source and having a plurality of exit ports in an upper section of said wall, said ports being sized and oriented to discharge said pressurized cooled fluid across an upper region of said pan;

wherein said source of pressurized fluid comprises:

an elongated chamber having first and second opposite end openings and a longitudinal axis;

a first cooling expansion duct spirally coiled about said axis within said chamber; and a blower shaped and oriented to circulate air from said first opening across said coiled duct and out of said second opening.

2. The food pan of claim 1 which further comprises a cooling expansion duct mounted along a circuitous path within said space and in contact with said liner.

3. The food pan of claim 1, wherein said inner liner has an air intake in a lower region of said pan, said air intake being connected to said first opening;

and wherein said manifold is connected to said second opening.

4. The food pan of claim 3, wherein said chamber and blower are located within said space and along said side wall.

5. The food pan of claim 3, which further comprises a second cooling expansion duct mounted along a circuitous path within said space and in contact with said liner.

6. The food pan of claim 5, wherein said second cooling expansion duct is in contact with said bottom plate and side wall.

7. The food pan of claim 4, wherein said chamber has an access port cut into said side wall; and said food pan further comprises a detachable panel closing said access port.

8. The food pan of claim 6, wherein said liner is made of metallic material.

9. The food pan of claim 1, wherein said source of pressurized fluid and said manifold do not extend below said bottom plate.

* * * * *